US011346254B2

(12) United States Patent
Eggleton

(10) Patent No.: US 11,346,254 B2
(45) Date of Patent: May 31, 2022

(54) ALIGNMENT TOOL

(71) Applicant: ROLLS-ROYCE PLC, London (GB)

(72) Inventor: Robert J. Eggleton, London (GB)

(73) Assignee: ROLLS-ROYCE PLC, London (GB)

( * ) Notice: Subject to any disclaimer, the term of this patent is extended or adjusted under 35 U.S.C. 154(b) by 373 days.

(21) Appl. No.: 16/502,864

(22) Filed: Jul. 3, 2019

(65) Prior Publication Data

US 2020/0011204 A1 Jan. 9, 2020

(30) Foreign Application Priority Data

Jul. 4, 2018 (GB) ..... 1811018

(51) Int. Cl.
*F01D 25/28* (2006.01)

(52) U.S. Cl.
CPC ..... *F01D 25/28* (2013.01); *F05D 2230/64* (2013.01)

(58) Field of Classification Search
CPC ..... F01D 25/28; F01D 25/285; F01D 21/045; F01D 11/12; F05D 2230/64; F05D 2300/603; F05D 2240/14; F05D 2220/36; F05D 2230/68; B29C 70/44; B29L 2031/7504; Y10T 29/4932; Y10T 29/49899; Y10T 29/49902; Y10T 29/53978

See application file for complete search history.

(56) References Cited

U.S. PATENT DOCUMENTS 2,446,119 A * 7/1948 White ..... C03C 25/321 524/47
2,642,999 A * 6/1953 McPherson ..... H01F 7/0252 211/65
3,579,617 A * 5/1971 Smith ..... G01B 3/00 264/34
2004/0231155 A1 11/2004 Le Saint et al.

FOREIGN PATENT DOCUMENTS

EP 1767325 A2 3/2007
EP 2103404 A2 9/2009
GB 2421470 A 6/2006

OTHER PUBLICATIONS

Dec. 21, 2018—(UK) Search Report—App GB1811018 9.

* cited by examiner

*Primary Examiner* — Lee A Holly
(74) *Attorney, Agent, or Firm* — Banner & Witcoff, Ltd.

(57) ABSTRACT

There is disclosed an alignment tool for positioning an impact liner panel on a fan casing. The alignment tool comprises an attachment portion for attaching to the fan casing, a support surface for receiving a shim, and a magnet to magnetically retain a shim on the support surface. There is also disclose a tool kit for manufacturing a fan casing having an alignment tool and a shim. There is also disclosed a method of positioning an impact liner panel on a fan casing. It comprises attaching an alignment tool to the fan casing, magnetically retaining a shim on a support surface of the alignment tool; and positioning the impact liner panel against an abutment surface of the shim.

11 Claims, 4 Drawing Sheets

ALIGNMENT TOOL

CROSS-REFERENCE TO RELATED APPLICATION

This application claims priority to and the benefit of United Kingdom Patent Application No. 1811018.9, filed Jul. 4, 2018, which prior application is incorporated herein by reference in its entirety.

TECHNICAL FIELD

The invention relates to an alignment tool, a tooling assembly and a method for positioning impact liner panels on a fan casing.

BACKGROUND

Gas turbine engines typically comprise impact liner panels which are mated to an inner surface of a composite fan casing after curing of the fan casing. The fan casing may have a complex or non-uniform internal profile, so that it is necessary to position the impact liner panels in the fan casing accurately, and adjust the axial location during assembly, in order to achieve the best possible bond-line between the impact liner panels and an adhesive layer on the fan casing.

SUMMARY

According to a first aspect, there is provided an alignment tool for positioning impact liner panels on a fan casing, the alignment tool comprising: an attachment portion for attaching to the fan casing; a support surface for receiving a shim; and a magnet to magnetically retain a shim on the support surface.

The magnet may be embedded within the alignment tool. The alignment tool may comprise a flange defining the support surface.

The flange may be configured to extend radially inwardly when the alignment tool is mounted to a radially inner wall of the fan casing. The magnet may be embedded within the flange of the alignment tool.

The alignment tool may comprise fibre reinforced polymer.

According to a second aspect, there is provided a tool kit comprising: an alignment tool in accordance with the first aspect; and a shim configured to be magnetically retained on the support surface of the alignment tool.

The tool kit may comprise a plurality of alignment tools and a plurality of shims.

The alignment tool may be configured to retain more than one shim.

According to a third aspect, there is provided a method of aligning a first and second component, the method comprising attaching a support to the first component; magnetically retaining a shim against the support; and placing the second component against an abutment surface of the shim.

According to a fourth aspect, there is provided a method of positioning an impact liner panel on a fan casing, the method comprising: attaching an alignment tool to the fan casing; magnetically retaining a shim on a support surface of the alignment tool; and positioning the impact liner panel against an abutment surface of the shim.

The abutment surface of the shim may be an opposite surface to that which is received on the support surface of the alignment tool. The method may comprise simultaneously retaining more than one shim against the support. The shims may have different thicknesses.

The support surface of the alignment tool may be defined by a flange of the alignment tool.

The method may comprise retaining a magnetic shim on the support surface, wherein the alignment tool comprises an embedded magnet.

The method may comprise applying a layer of adhesive to the fan casing before positioning the impact liner, and curing the adhesive in a curing operation to secure impact liner to the fan casing. For the curing operation, a vacuum bag may be applied over the impact liner and the fan casing. The impact liner may be cured before positioning it on the fan casing. The fan casing may already be cured before the curing operation.

The method may comprise removing the alignment tool from the fan casing after curing the adhesive to secure the impact liner to the fan casing.

The method may comprise checking an axial position of the impact liner panel and, if the impact liner panel is not correctly axially located with respect to the fan casing, removing the shim, or replacing the shim with a shim of different thickness, and/or adding one or more additional shims to axially move the abutment surface within the fan casing as required As noted elsewhere herein, the present disclosure may relate to a gas turbine engine. Such a gas turbine engine may comprise an engine core comprising a turbine, a combustor, a compressor, and a core shaft connecting the turbine to the compressor. Such a gas turbine engine may comprise a fan (having fan blades) located upstream of the engine core.

Arrangements of the present disclosure may be particularly, although not exclusively, beneficial for fans that are driven via a gearbox. Accordingly, the gas turbine engine may comprise a gearbox that receives an input from the core shaft and outputs drive to the fan so as to drive the fan at a lower rotational speed than the core shaft. The input to the gearbox may be directly from the core shaft, or indirectly from the core shaft, for example via a spur shaft and/or gear. The core shaft may rigidly connect the turbine and the compressor, such that the turbine and compressor rotate at the same speed (with the fan rotating at a lower speed).

The gas turbine engine as described and/or claimed herein may have any suitable general architecture. For example, the gas turbine engine may have any desired number of shafts that connect turbines and compressors, for example one, two or three shafts. Purely by way of example, the turbine connected to the core shaft may be a first turbine, the compressor connected to the core shaft may be a first compressor, and the core shaft may be a first core shaft. The engine core may further comprise a second turbine, a second compressor, and a second core shaft connecting the second turbine to the second compressor. The second turbine, second compressor, and second core shaft may be arranged to rotate at a higher rotational speed than the first core shaft.

In such an arrangement, the second compressor may be positioned axially downstream of the first compressor. The second compressor may be arranged to receive (for example directly receive, for example via a generally annular duct) flow from the first compressor.

The gearbox may be arranged to be driven by the core shaft that is configured to rotate (for example in use) at the lowest rotational speed (for example the first core shaft in the example above). For example, the gearbox may be arranged to be driven only by the core shaft that is configured to rotate (for example in use) at the lowest rotational speed (for example only be the first core shaft, and not the second core shaft, in the example above). Alternatively, the gearbox may be arranged to be driven by any one or more shafts, for example the first and/or second shafts in the example above.

In any gas turbine engine as described and/or claimed herein, a combustor may be provided axially downstream of the fan and compressor(s). For example, the combustor may be directly downstream of (for example at the exit of) the second compressor, where a second compressor is provided. By way of further example, the flow at the exit to the combustor may be provided to the inlet of the second turbine, where a second turbine is provided. The combustor may be provided upstream of the turbine(s).

The or each compressor (for example the first compressor and second compressor as described above) may comprise any number of stages, for example multiple stages. Each stage may comprise a row of rotor blades and a row of stator vanes, which may be variable stator vanes (in that their angle of incidence may be variable). The row of rotor blades and the row of stator vanes may be axially offset from each other. A fan blade and/or aerofoil portion of a fan blade described and/or claimed herein may be manufactured from any suitable material or combination of materials. For example at least a part of the fan blade and/or aerofoil may be manufactured at least in part from a composite, for example a metal matrix composite and/or an organic matrix composite, such as carbon fibre. By way of further example at least a part of the fan blade and/or aerofoil may be manufactured at least in part from a metal, such as a titanium based metal or an aluminium based material (such as an aluminium-lithium alloy) or a steel based material. The fan blade may comprise at least two regions manufactured using different materials. For example, the fan blade may have a protective leading edge, which may be manufactured using a material that is better able to resist impact (for example from birds, ice or other material) than the rest of the blade. Such a leading edge may, for example, be manufactured using titanium or a titanium-based alloy. Thus, purely by way of example, the fan blade may have a carbon-fibre or aluminium based body (such as an aluminium lithium alloy) with a titanium leading edge.

A fan as described and/or claimed herein may comprise a central portion, from which the fan blades may extend, for example in a radial direction. The fan blades may be attached to the central portion in any desired manner. For example, each fan blade may comprise a fixture which may engage a corresponding slot in the hub (or disc). Purely by way of example, such a fixture may be in the form of a dovetail that may slot into and/or engage a corresponding slot in the hub/disc in order to fix the fan blade to the hub/disc.

The fan of a gas turbine as described and/or claimed herein may have any desired number of fan blades, for example 16, 18, 20, or 22 fan blades.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

BRIEF DESCRIPTION OF THE DRAWINGS

Embodiments will now be described by way of example only, with reference to the Figures, in which.

DETAILED DESCRIPTION

Figure 1:
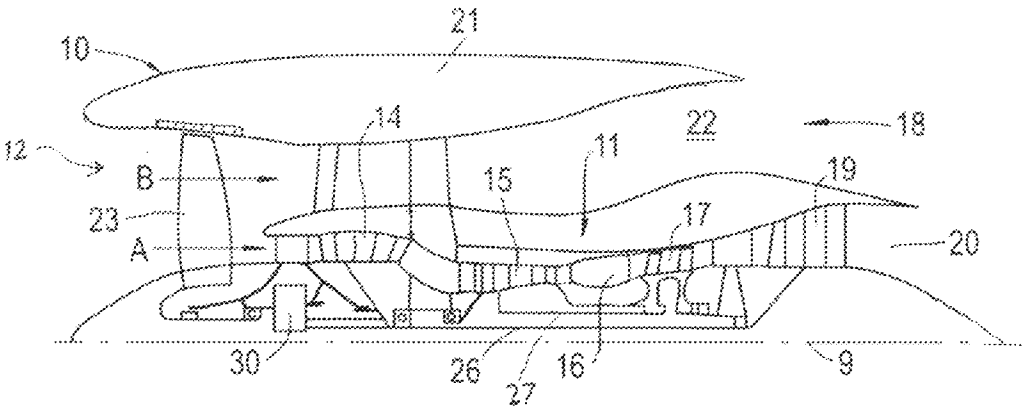
FIG. 1 is a sectional side view of a gas turbine engine.

FIG. 1 illustrates a gas turbine engine 10 having a principal rotational axis 9. The engine 10 comprises an air intake 12 and a propulsive fan 23 that generates two airflows: a core airflow A and a bypass airflow B. The gas turbine engine 10 comprises a core 11 that receives the core airflow A. The engine core 11 comprises, in axial flow series, a low pressure compressor 14, a high-pressure compressor 15, combustion equipment 16, a high-pressure turbine 17, a low pressure turbine 19 and a core exhaust nozzle 20. A nacelle 21 surrounds the gas turbine engine 10 and defines a bypass duct 22 and a bypass exhaust nozzle 18. The bypass airflow B flows through the bypass duct 22. The fan 23 is attached to and driven by the low pressure turbine 19 via a shaft 26 and an epicyclic gearbox 30.

In use, the core airflow A is accelerated and compressed by the low pressure compressor 14 and directed into the high pressure compressor 15 where further compression takes place. The compressed air exhausted from the high pressure compressor 15 is directed into the combustion equipment 16 where it is mixed with fuel and the mixture is combusted. The resultant hot combustion products then expand through, and thereby drive, the high pressure and low pressure turbines 17, 19 before being exhausted through the nozzle 20 to provide some propulsive thrust. The high pressure turbine 17 drives the high pressure compressor 15 by a suitable interconnecting shaft 27. The fan 23 generally provides the majority of the propulsive thrust. The epicyclic gearbox 30 is a reduction gearbox.

Other gas turbine engines to which the present disclosure may be applied may have alternative configurations. For example, such engines may have an alternative number of compressors and/or turbines and/or an alternative number of interconnecting shafts. By way of further example, the gas turbine engine shown in FIG. 1 has a split flow nozzle 20, 22 meaning that the flow through the bypass duct 22 has its own nozzle that is separate to and radially outside the core engine nozzle 20. However, this is not limiting, and any aspect of the present disclosure may also apply to engines in which the flow through the bypass duct 22 and the flow through the core 11 are mixed, or combined, before (or upstream of) a single nozzle, which may be referred to as a mixed flow nozzle. One or both nozzles (whether mixed or split flow) may have a fixed or variable area. Whilst the described example relates to a turbofan engine, the disclosure may apply, for example, to any type of gas turbine engine, such as an open rotor (in which the fan stage is not surrounded by a nacelle) or turboprop engine, for example. In some arrangements, the gas turbine engine 10 may not comprise a gearbox 30.

The geometry of the gas turbine engine 10, and components thereof, is defined by a conventional axis system, comprising an axial direction (which is aligned with the rotational axis 9), a radial direction (in the bottom-to-top direction in FIG. 1), and a circumferential direction (perpendicular to the page in the FIG. 1 view). The axial, radial and circumferential directions are mutually perpendicular.

Figure 2:
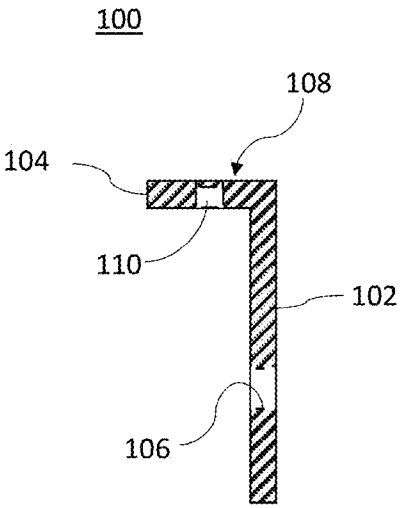
FIG. 2 shows a cross sectional view of an alignment tool.

FIG. 2 shows a cross sectional view of an alignment tool 100 for positioning impact liner panels on an inner surface of a fan casing. The alignment tool 100 comprises an attachment portion 102 and a flange 104 extending from the attachment portion 102. In this example, the alignment tool 100 is made from carbon fibre reinforced polymer (CFRP). However, in other examples the alignment tool may be made from any suitable material such as a metal, glass fibre reinforced polymer (GFRP) or any fibre reinforced composite material.

The attachment portion 102 is configured to be attached to a fan casing. The attachment portion 102 has an arcuate profile corresponding to the profile of the fan casing where it is to be attached, so that a radially outer surface of the attachment portion 102 is configured to correspond to a radially inner surface of the fan casing, such that the attachment portion 102 can lie flush against the fan casing in use.

The attachment portion 102 is generally elongate in a radial cross section along an axis corresponding to the central axis of the casing when installed.

Figure 3:
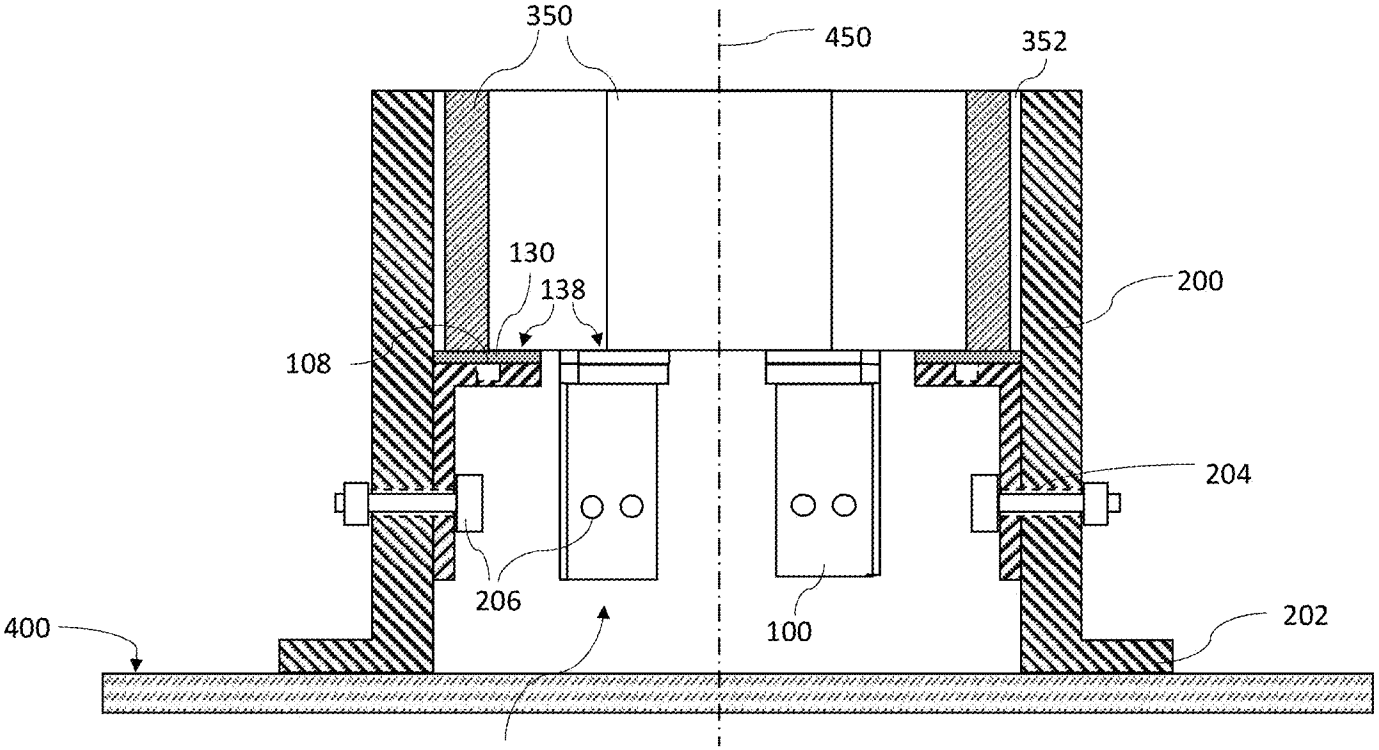
FIG. 3 shows a cross-sectional view of a fan casing with a tooling assembly in use to position an impact liner on a fan casing.

In this example, the attachment portion 102 comprises two holes 106 for receiving bolts for attachment to the fan casing (best shown in FIG. 3). In other examples the holes may be configured to receive a screw, the holes may be threaded and/or there may be more than two holes. In yet other examples the attachment portion may comprise an adhesive on the radially outer surface for adhering the alignment tool to the radially inner surface of the fan casing, or may be configured to be clamped to the fan casing.

In this example, the flange extends perpendicularly with respect to the elongate direction of the attachment portion, such that it is normal to the axial direction of the fan casing when installed.

The flange 104 defines a support surface 108 on an outer surface of the alignment tool 100 facing away from the rest of the alignment tool 100, for receiving a shim and/or to serve as an abutment surface for receiving an impact liner.

A magnet 110 is embedded within the flange 104. In this example, the magnet 110 extends from an inner surface of the flange 104 proximate the attachment portion 102 and terminates under the support surface 108 of the flange 104. The magnet 110 may be positioned flush with the support surface 108 provided that it does not obstruct reception of a shim by protruding from the support surface 108. A shim may therefore be magnetically retained on the support surface 108 of the alignment tool 100.

The magnet 110 is embedded in the flange 104 by drilling a hole through the flange 104, such as a through hole or a blind hole, after curing of the alignment tool 100, then applying adhesive in the hole and placing the magnet 110 in the hole so that it adheres to the flange 104. In other examples, the adhesive may be dispensed with and the magnet 110 may be embedded in the hole by interference coupling. In other examples, the magnet may be embedded in the flange during manufacture of the alignment tool i.e. during lay-up of the alignment tool.

FIG. 3 shows a cross sectional view of a rear portion of a fan casing 200 with a tooling assembly 150 installed to accurately position a plurality of impact liners 350 around an inner surface of the fan casing 200.

FIG. 3 shows a cylindrical fan casing 200 for simplicity, having a centreline 450 defining an axial direction of the fan casing 200. However, a fan casing may have a circular con-di (convergent and divergent) profile, or any other axially varying cross-sectional profile. It may be important to precisely axially locate the liner panels 350 in the fan casing 200 to ensure that the profiles of the fan casing and the liner panels match, particularly for axially varying profiles.

In this example, the fan casing 200 is made of carbon fibre reinforced polymer (CFRP) and comprises a fan casing flange 202 at the rear end of the fan casing 200. FIG. 3 shows the fan casing flange 202 resting on a horizontal surface 400 such as the ground, such that the centreline 450 of the fan casing 200 is vertical. The fan casing 200 comprises a plurality of pairs of bolt holes 204 around its circumference, each at the same axial position along the fan casing 200, near the fan casing flange 202 for receiving a bolt 206. In some examples, the bolts may be secured with corresponding nuts. In other examples, the holes may be threaded holes for receiving the bolts, or the holes may receive a threaded insert for receiving the bolt.

The tooling assembly 150 comprises a plurality of alignment tools 100, and a plurality of shims 130. In this example, there are eight alignment tools 100, and eight corresponding shims 130 (only four of each are shown in the cross section of FIG. 3). However, in other examples, there may be more or fewer alignment tools and shims. In yet other examples, there may be more shims than alignment tools. In this example, the number of alignment tools 100 corresponds to the number of liner panels 350 which are to be placed in the fan casing 200.

The alignment tools 100 are evenly spaced around the fan casing 200, and each alignment tool 100 is substantially the same. Therefore, the tooling assembly 150 will be described below with respect to one alignment tool 100 and a corresponding shim 130.

The alignment tool 100 is attached by the attachment portion 102 to the fan casing 200, with bolts 206. The alignment tool 100 is positioned within the fan casing 200 so that the flange 104 is located axially inwardly in the fan casing 200 relative the attachment portion 102, and extends radially inwards from the attachment portion 102, so as to support an end of a liner panel when the panel is disposed towards an axial centre of the casing.

Although it has been described that the flange 104 of the alignment tool 100 is perpendicular to the attachment portion 102 of the alignment tool 100, the angle between the flange and the attachment portion may be any suitable angle such that the support surface 108 is oriented to co-operate with an end surface of a liner panel, for example by being substantially horizontal when the alignment tool 100 is attached to the fan casing 200, and the fan casing 200 rests on a horizontal surface as shown in FIG. 3.

A shim 130 is magnetically retained against the support surface 108 of the alignment tool 100. The shim 130 is in the form of a steel plate with 1 mm thickness with a profile corresponding to the support surface 108 of the alignment tool 100. The shim 130 defines an abutment surface 138 for receiving an impact liner 350. The abutment surface 138 is the opposite surface to that which is received on the support surface 108 of the alignment tool 100. Either surface may be considered an abutment surface before use.

Although it has been described that the shim 130 has a thickness of 1 mm, in other examples, the shim may have a thickness less than 1 mm or more than 1 mm such as comprised between 0.01 mm and 3 mm, for example 0.25 mm, 0.5 mm or 2 mm. In yet other examples, the tooling assembly 150 may comprise a plurality shims for each alignment tool, where the plurality of shims may have the same, or different thicknesses.

The axial location of the abutment surface 138 along the fan casing can be easily changed by replacing the shim with a shim of different thickness. The alignment tool 100 may also be configured to magnetically retain more than one shim 130, so that the axial location of the abutment surface can be changed by adding or removing shims of the same or different thicknesses to be retained on the alignment tool 100.

The liner panels 350 are located around the inner surface of the fan casing 200 so that an axial end of each liner panel rests on an abutment surface 138 of a shim, or if no shim is necessary, on the support surface 108 of the alignment tool 100. In this example, there are eight liner panels 350, each liner panel 350 resting on two alignment tools 100 on opposite sides of the axial end of the liner panel 350, such that one alignment tool 100 partially supports axial ends of two adjacent liner panels 350. A layer of adhesive 352, such as epoxy resin, is disposed between the liner panels 350 and the fan casing 200 to secure the liner panels 350 to the fan casing when the adhesive 352 is cured.

Figure 4:
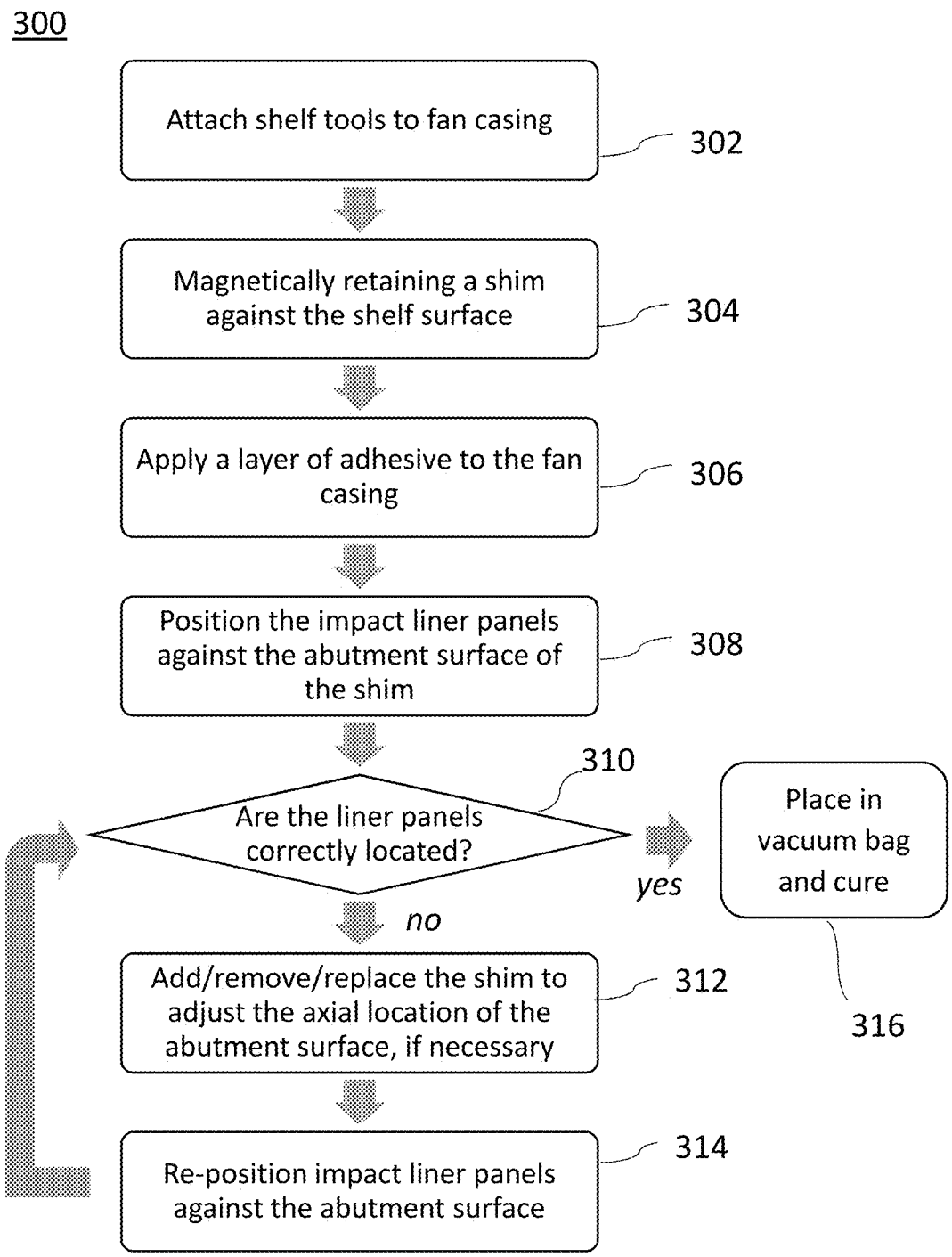
FIG. 4 is a flow chart showing steps of a method for positioning impact liner panels on a fan casing.

FIG. 4 is a flow chart showing steps of a method 300 for positioning the impact liner panels 350 on the fan casing 200 and will be described by way of example with respect to the alignment tool 100 and shim 130 of FIGS. 2-3. The fan casing 200 rests on the horizontal surface 400 as shown in FIG. 3. In step 302, the plurality of alignment tools 100 are attached to the fan casing 200 as shown in FIG. 3. In step 304, a shim 130 of 1 mm thickness is retained on the support surface 108 of each alignment tool 100. In other examples, the shims may be magnetically retained on the respective alignment tools before the alignment tools are attached to the fan casing.

In step 306, a layer of adhesive 352 is applied to the inner surface of the fan casing 200. In other examples, this step can be carried out before attaching the alignment tools to the fan casing, or before magnetically retaining the shims against the alignment tools.

In step 308, the liner panels 350 are placed against the adhesive layer 352 and rest, under gravity, against the abutment surface 138 of the shim 130. In step 310, the axial positions of the liner panels 350 are checked to ensure that they are correctly located with respect to the fan casing 200. For example, the conformance of the profile of the liner panel to the profile of the fan casing may be checked at the axial location. If the liner panel are not correctly located, the method proceeds to step 312. If they are positioned correctly, the method proceeds to step 316.

In step 312, the shim 130 is removed or replaced with a shim of different thickness, or another shim is added to be magnetically retained against the flange 104 of the alignment tool 100, to axially move the abutment surface 138 within the fan casing 200 as required. In step 314, the liner panels are re-positioned against the adhesive layer 352 and rest against abutment surface 138 of the shim 130, and the method returns to step 310 to check whether the liner panels are positioned correctly.

In this example, the alignment tool 100 is made so that the support surface 108 of the flange 104 is 1 mm below the intended end position of the liner panel 350 so that the addition of a shim 130 of 1 mm brings the abutment surface 138 to the required axial location in the fan casing 200. In other words, the support surface 108 defines a lower limit for the intended end position of the liner panel 350. If the lower limit does not match the intended end position of the liner panel 350, one or more shims 130 of suitable thickness may be positioned on the flange 104 to adjust the position of the abutment surface 138 and therefore the axial position of the liner panel 350. Each alignment tool 100 can be adjusted individually and independently from each other.

Once the liner panels 350 have been correctly positioned, the method proceeds to step 316. In step 316, a vacuum bag is applied over the impact liner panels 350 and tool assembly 150 on the fan casing 200, and the adhesive layer 352 is cured under elevated temperature and pressure (such as in an autoclave) to secure the liner panels 350 to the fan casing 200.

Once the adhesive layer 352 has been cured, the tooling assembly 150 is removed from the fan casing 200. The shims and fan casing in this example are made from the same material (CFRP in this example), so that there is no differential thermal expansion during curing of the adhesive, so that the axial position of the liner panels 350 relative the fan casing 200 does not change during the curing of the adhesive.

Since the alignment tool 100 has a magnet 110, the shim can be retained on the alignment tool magnetically, without requiring a layer of adhesive or tape, which would change the thickness or tolerance of the shim. Tape applied and removed repeatedly on a shim leaves a residue which requires regular cleaning to ensure that the thickness of the shim is not changed over time. Further, taping a shim to an alignment tool requires more consumables and is more time consuming than magnetically retaining the shim.

Therefore, the magnetic alignment tool and shim allows quick and simple alteration of the axial location of the abutment surface for adjusting the axial position of the liner panels.

Although it has been described that the shim is made of steel, in other examples, the shims may be made from any magnetic material.

Although it has been described that the alignment tool is attached to the fan casing for providing a support surface, the alignment tool can take the form of any support which provides a horizontal support surface when the support is attached to the fan casing, and the flange of the fan casing is resting on the horizontal surface.

Although it has been described that the alignment tool and shim are used for positioning impact liner panels on an inner surface of a fan casing, the alignment tool or tool kit can be used to align any components relative one another.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

The invention claimed is:

1. A method of positioning an impact liner panel on a fan casing, the method comprising:

attaching an alignment tool to the fan casing;

magnetically retaining a shim on a support surface of the alignment tool; and positioning the impact liner panel against an abutment surface of the shim.

2. The method according to claim 1, comprising applying a layer of adhesive to the fan casing before positioning the impact liner panel, and curing the adhesive in a curing operation to secure the impact liner panel to the fan casing.

3. The method according to claim 2, comprising removing the alignment tool from the fan casing after curing the adhesive to secure the impact liner panel to the fan casing.

4. The method according to claim 1, comprising retaining a magnetic shim on the support surface, wherein the alignment tool comprises an embedded magnet.

5. The method according to claim 1, further comprising checking an axial position of the impact liner panel and, if the impact liner panel is not correctly axially located with respect to the fan casing, removing the shim, or replacing the shim with a shim of different thickness, and/or adding one or more additional shims to axially move the abutment surface within the fan casing as required.

6. A tool kit for manufacturing a fan casing, the tool kit comprising:

an alignment tool for positioning impact liner panels on a fan casing, the alignment tool comprising:

an attachment portion for attaching to the fan casing;

a support surface for receiving a shim; and a magnet to magnetically retain a shim on the support surface; and a shim configured to be magnetically retained on the support surface of the alignment tool.

7. The tool kit according to claim 6, comprising a plurality of alignment tools and a plurality of shims.

8. The tool kit according to claim 6, wherein the alignment tool is configured to retain more than one shim.

9. The tool kit according to claim 6, wherein the magnet is embedded within the alignment tool.

10. The tool kit according to claim 6, comprising a flange defining the support surface.

11. The tool kit according to claim 6, wherein the alignment tool comprises fibre reinforced polymer.

* * * * *